US005184814A

United States Patent [19]

Manning

[11] Patent Number: 5,184,814

[45] Date of Patent: Feb. 9, 1993

[54] BASKETBALL TRAINING DEVICE

[76] Inventor: Gary Manning, P.O. Box 715, Delancey, N.Y. 13752

[21] Appl. No.: 917,416

[22] Filed: Jul. 23, 1992

Related U.S. Application Data

[63] Continuation-in-part of Ser. No. 817,070, Jan. 6, 1992.

[51] Int. Cl.[5] ..... A63B 69/00

[52] U.S. Cl. ..... 273/1.5 A

[58] Field of Search ..... 273/1.5 A, 1.5 R, 396

[56] References Cited

U.S. PATENT DOCUMENTS

| | | | |
|---|---|---|---|
| 2,808,264 | 10/1957 | Scalf | 273/1.5 A |
| 3,814,421 | 6/1974 | Spier, Jr. | 273/1.5 A |
| 3,917,263 | 11/1975 | Wiley | 273/1.5 A |
| 4,291,885 | 9/1981 | Cohen | 273/347 |
| 4,579,339 | 4/1986 | Grimm | 273/1.5 A |
| 4,720,101 | 1/1988 | Farkas, Jr. | 273/1.5 A |
| 4,936,577 | 6/1990 | Kington et al. | 273/1.5 A |

*Primary Examiner*—Paul E. Shapiro
*Attorney, Agent, or Firm*—Gustalo Nunez

[57] ABSTRACT

A basketball training device which is a combination of a generally circular first upper member and a generally circular second lower member, with the second lower member rotatable with respect to the first upper member. The combination is attached to a conventional basketball hoop by means of mounting clamps positioned on the first circular member. The lower member terminates in a lateral direction such that it directs the return of the basketball to a specific location. The second bottom member is capable of being rotated 360 degrees with respect to the first member is directly attached to a basketball hoop.

1 Claim, 4 Drawing Sheets

BASKETBALL TRAINING DEVICE

FIELD OF THE INVENTION

The present invention which is a continuation in part of application Ser. No. 07/817,070 filed Jan. 6, 1992, relates to a basketball training device which returns the ball to the player upon successfully shooting a basketball through the hoop.

BACKGROUND OF THE INVENTION

Basketball is a sport, like many other sports, which requires discipline and training and more training. The object in basketball is to shoot the ball such that the ball goes through the hoop which is attached to a conventional backboard. This is how points are scored, whether thrown from the free throw line or during actual play. To get good at the game, one must spend hours of practice of shooting the ball at the basketball hoop until one develops the accuracy required to be competitive. Often times one must practice alone, which requires the practicing player to chase the ball, after shooting, in order to retrieve the ball. Chasing the ball can dampen the player's enthusiasm for the game and could result in shortened practice sessions. What would help the practicing player is to have a training device which would direct the ball back to the player. The present invention does that very simply and is rotatably adjustable such that the player can practice shots from any position on the gym floor.

The following U.S. patents are submitted as being of interest: U.S. Pat. No. 4,291,885, U.S. Pat. No. 4,579,339 and U.S. Pat. No. 3,917,263.

Coen, U.S. Pat. No. 4,291,885, describes a basketball game which can be played by a person confined to a bed or wheel chair. The ball is returned to the participant by a net deployed below the basketball hoop on the backboard at one end and to the player at the other end.

Grimm, U.S. Pat. No. 4,579,339, also discloses a device for returning basketballs. The device includes a frame which supports a slide which directs the ball back to the shooter. The frame, in order to change the direction of the ball as it passes through the hoop, must be rotated about the basketball rim.

Similarly, Wiley, U.S. Pat. No. 3,917,263, illustrates a basketball return device which is an enlarged basket positioned under the basketball hoop. As the basket ball passes downwardly through the hoop, it is caught by the enlarged basket and carried down and outwardly by some chute guide means.

The present invention, unlike those discussed above, is a device that can direct the ball towards any desired direction in a non-complicated manner and which can be easily removed and/or placed on the basketball hoop.

SUMMARY OF THE INVENTION

The present invention is directed to a basketball return device which can be set up and used by a single player. The ball guide means is rotatably adjustable such that the ball return can be directed in any direction. The player simply shoots the ball at the hoop; upon passing through the hoop, the basketball is taken by the basketball return device and directed back to the player.

It is to be understood that further objects and features of the invention will be apparent from consideration of the accompanying drawings illustrating the invention.

BRIEF DESCRIPTION OF THE DRAWINGS

The complete drawing of the preferred embodiment of this invention is shown in.

DESCRIPTION OF THE PREFERRED EMBODIMENT

Figure 1:
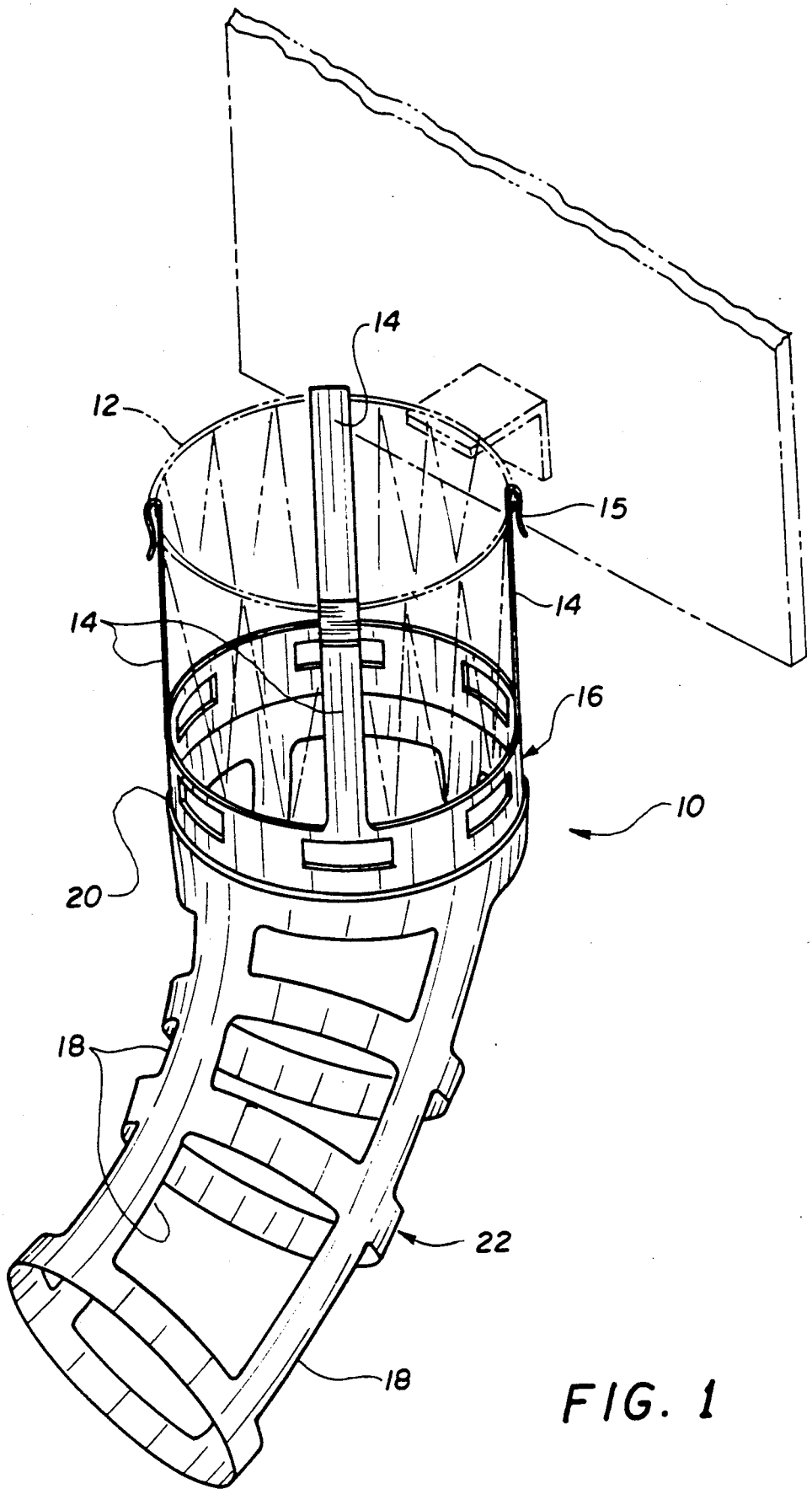
FIG. 1 is a perspective view of the invention connected to a basketball hoop.
Figure 3:
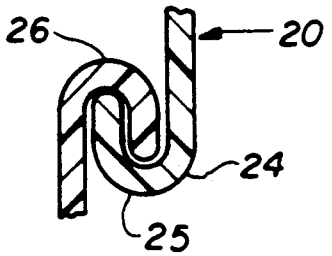
FIG. 3 is an enlarged cross-sectional view of the moveable connection between the top and bottom members of the invention.
Figure 2:
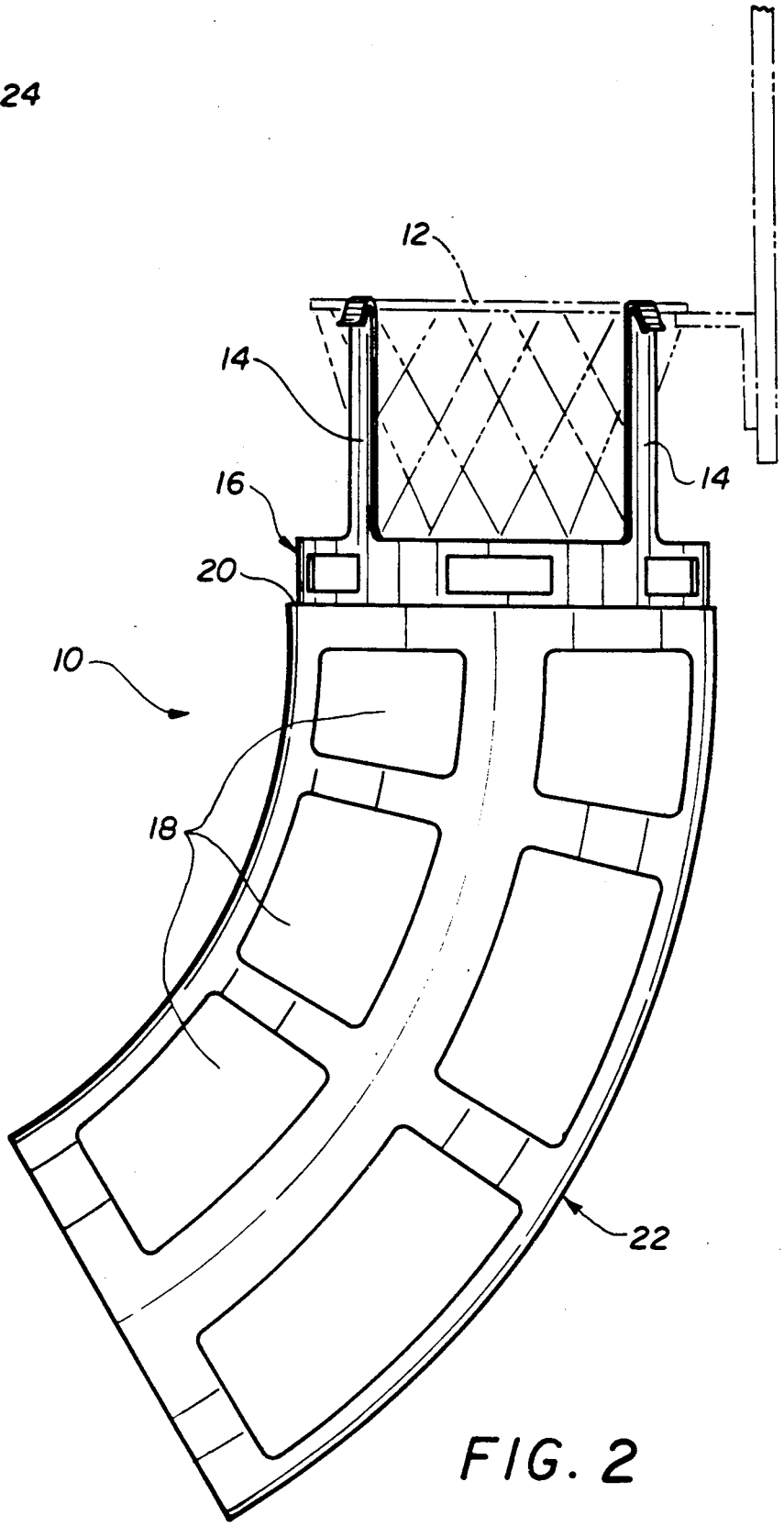
FIG. 2 is a side view of the invention.

Referring now to the drawings, the basketball training device is identified as the reference numeral 10 and which is used in combination with a standard basketball hoop which is connected to a standard basketball backboard by the usual conventional methods. The backboard is not a part of this invention. FIG. 1 illustrates the basketball training device 10 as comprising two members 16 and 22 with member 16 being the upper member and member 22 being the bottom member. Top member 16 consists of a circumferential ring 24 attached to four vertically rising stringers 14. The extreme upper portion of the stringers 14 are folded over in a hooklike configuration 15. The bottom portion of the ring 24, terminates a U-type configuration 25.

The stringers 14 are biased in a direction extending outwards from the longitudinal axis defined by tubular assembly 16. The stringers 14, as can be seen in FIG. 1, at the upper portion thereof, have hook-shaped terminating ends 15, for engaging the basketball hoop. The stringers 14 may be biased in an inwardly direction, if so desired, however, it would be necessary to reverse the hook-shaped configuration. Although four mounting clamps 14 are shown, a lesser number or greater number could be used.

Connected to the tubular assembly 16 is bottom member 22 which functions as the chute assembly. The top portion of the bottom member 22 terminates in an inverted U-shape configuration 26 and is designed to be engagingly received by the U-shape configuration 25, thus, bottom member 22 is rotatably adjustable with respect to the top member 16. Bottom member 22 can be rotated a full 360 degrees simply be rotating the bottom member 22.

Referring to the line identified as 20, i.e. the point where the top member 16 and bottom member 22 are connected, as one proceeds downwardly from 20, the bottom member 22 is angularly disposed with respect to the top member 16 such that the downward portion of the chute assembly is open in an outwardly, somewhat laterally, direction with respect to the longitudinal axis defined by the top member 16.

In FIG. 1, there are shown, four stringers 14 connected to the hoop 12. The stringers 14, in the manufacturing process are biased outwardly such that the mounting hooks are in firm engagement with the hoop 12. Similarly, the mounting clamps 14 could be biased in an inwardly direction which would require the hook-shaped terminating ends to be reversed as was previously mentioned.

The basketball training device 10 may be manufactured from plastic materials, or ferrous materials and other materials such as reinforced aluminum.

In use, the player simply rotates bottom member 22 in the direction that he wants the ball to be directed. This is accomplished simply by rotating the bottom member 22 with respect to top member 16. Although the top member 16 and bottom member 22 are rotatably connected to each other by matching U-shaped terminating ends, it is obvious that other type connections can be made. At such time that the player makes a basket, the ball will pass through the basketball training device 10 and be directed back to the player, who will again perform the shooting process.

Although the basketball training device 10 has been disclosed as having see-through holes 18, the invention is not restricted to such a structure.

Figure 4:
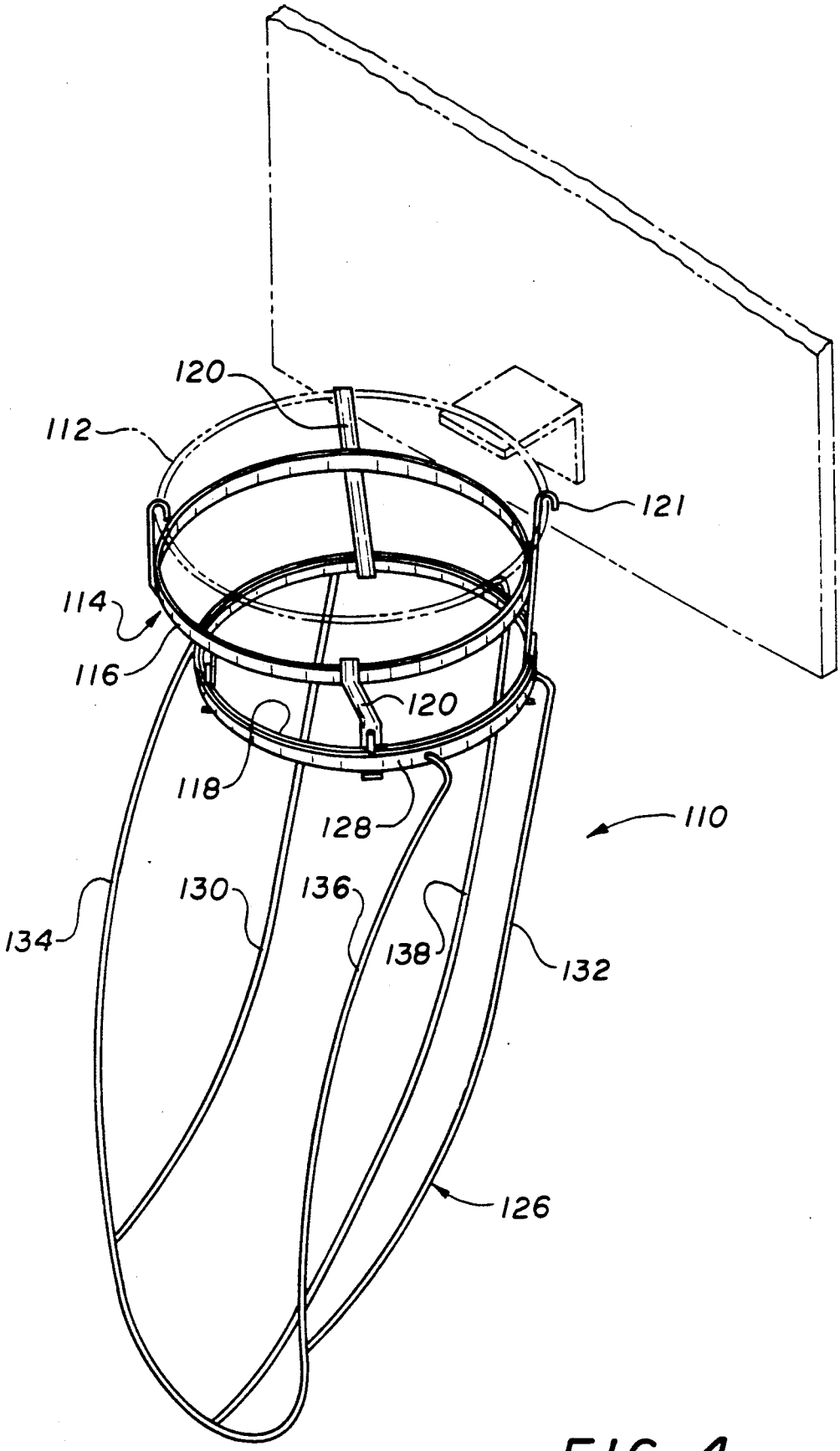
FIG. 4 is a perspective view of a second embodiment of the invention connected to a basketball hoop.
Figure 5:
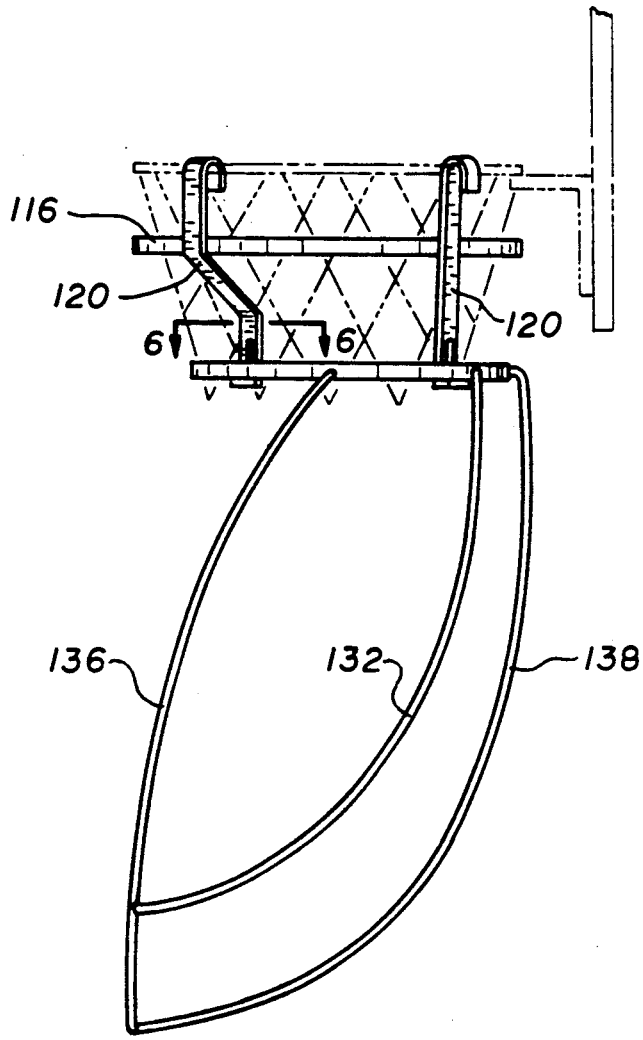
FIG. 5 is a side view of the invention.
Figure 6:
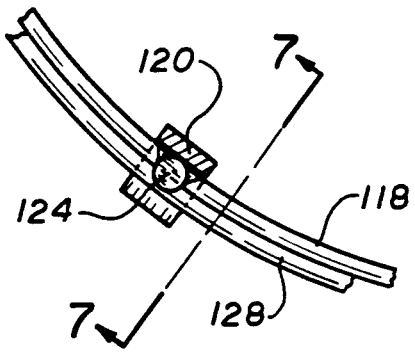
FIG. 6 is a view of the moveable connection between the top member and bottom member taken along lines 6—6 of FIG. 5.
Figure 7:
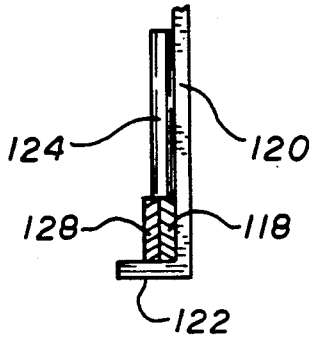
FIG. 7 is an enlarged side cross-sectional view taken of the moveable connection taken along line 7—7 of FIG. 6.

Referring to FIG. 4, there is illustrated a second embodiment 110 of the invention which also is used in combination with a standard basketball hoop. FIG. 4 illustrates a basketball hoop 112 attached to a conventional backboard. The training device 112 consists of two separate upper and lower distinct members rotatably connected to each other. A first member 114 forms the upper portion of the training device 112 and consists of two rings 116 and 118. In the embodiment shown, ring 118 is shown as having a smaller diameter than that of ring 116, however, the invention need not be restricted thereto, in as much as the first member would function equally well with the rings 116 and 118 having similar diameters. The rings 116 and 118 are connected to each other by a plurality of straps 120, four in the embodiment shown. The rings 116 and 118 are in parallel spaced relationship with respect to each other. The straps 120, extend in an upward direction, past ring 116 and each strap 120 then terminates in a hook 121. The bottom portion of the strap 120 terminates in an L-shaped configuration, see FIG. 7, with the L-portion 122 radially extending in a direction away from the longitudinal axis defined by rings 116 and 118. Mounted to the lower portion of straps 120 is a stop bar 124 whose purpose will soon be evident. A second member 126 forms the bottom portion of the basketball training device 110. The upper portion of the second member 126 consists of a ring 128, wherein the diameter of ring 128 is such that it can be superimposed about ring 118 in a moveable relationship. Attached to ring 128 are a plurality of risers 130, 132, 134 and 136 with risers 130, 132, 134 and 136 being somewhat identical and projecting downwardly in an arcing fashion such that the bottom portions of risers 130, 132, 134 and 136 are laterally disposed at same angle with respect to the longitudinal axis defined by the rings 116 and 118. Risers 130, 132, 134 and 136 are connected at their lower portion to yet another riser 138 which the upper end is connected to ring 128. Riser 138 projects downwardly from ring 128 to the terminating ends of risers 130, 132, 134 and 136. The second member 126 is moveably connected to the first member 114 by placing the ring member 128 about ring member 118 such that ring member 128 completely surrounds ring member 118 and rests on L-member 122. Referring to FIG. 7, ring member 128 rests on L-member 122 and is held in place by stop bar 124.

In use, the straps 120 are mounted on to a basketball hoop by use of the hooks 121. The straps 120 are based such that they will be in a generally fixed connection with respect to the basketball hoop. One mounted to the basketball hoop, the user need only to grab the bottom member 126 and rotate bottom member 126 to whatever angle the user desires the ball to be directed.

It is to be understood that the above described embodiment of the invention is for the purpose of illustration, and various changes may be made without departing from the spirit and scope of the invention.

What is claimed is:

1. A basketball training device comprising:

a first upper member including first and second circumferential rings connected with respect to each other in a parallel spaced relationship by a plurality of mounting straps, said mounting straps at one end thereof terminating in a U-shaped configuration for engagement with a basketball hoop, said mounting straps at another end thereof, terminating in a L-configuration, and including a non-movable bar positioned upwardly from said L-configuration, a said lower member including a circumferential ring member at one end thereof, said ring member having a diameter such that said ring member and said second ring member of said upper member are superimposed with respect to each other, said circumferential ring member held in place about said second ring member of said upper member by said non-moveable bar, in combination with the L-configuration, said lower member having a rotation of 360 degrees with respect to said first upper member, a plurality of laterally disposed risers connected to said ring member, said laterally disposed risers directing the travel of a basketball passing through said basketball training device.

* * * * *